United States Patent [19]

Tarbon et al.

[11] 4,275,554

[45] Jun. 30, 1981

[54] CLEARANCE-PRODUCING MEANS FOR OPEN-END SPINNING MACHINE SERVICING APPARATUS

[75] Inventors: Philip B. Tarbon, Pendleton; Charles R. Martin, Seneca, both of S.C.

[73] Assignee: Platt Saco Lowell Limited, Helmshore, England

[21] Appl. No.: 100,608

[22] Filed: Dec. 5, 1979

[51] Int. Cl.[3] ..... D01H 15/02; D01H 1/12

[52] U.S. Cl. ..... 57/263; 57/1 R

[58] Field of Search ..... 57/1 R, 261–263, 57/268, 270, 271

[56] References Cited

U.S. PATENT DOCUMENTS

| | | | |
|---|---|---|---|
| 3,651,628 | 3/1972 | Harmon et al. | 57/261 X |
| 3,712,040 | 1/1973 | Harmon | 57/261 |
| 3,892,062 | 7/1975 | Stahlecker et al. | 57/263 |
| 3,908,346 | 9/1975 | Lee, Jr. | 57/261 |
| 3,990,221 | 11/1976 | Stahlecker | 57/263 |
| 4,060,963 | 12/1977 | Stahlecker et al. | 57/1 R |

*Primary Examiner*—John Petrakes

*Attorney, Agent, or Firm*—Joseph H. Heard

[57] ABSTRACT

The servicing apparatus is mounted for running movement along, and for pivotal movement laterally of, a path of travel having a first section extending adjacent spinning units of the spinning machine and a second section extending adjacent an end cabinet of the spinning machine. During movement of the apparatus from the first and to the second section of its path of travel, it is pivoted laterally of such path to provide clearance between interfering components of the apparatus and the cabinet of the machine that would otherwise preclude movement of the apparatus along the second section of its path of travel. Pivotal movement of the apparatus is realized by a cam means so located as to not impede traffic adjacent the machine or access to the interior of its end cabinet, and as to minimize the magnitude of the force required to produce the aforesaid pivotal movement. In an alternative embodiment one of the interference-causing components of the apparatus is moved to a retracted position as the apparatus passes from the first and to the second section of its path of travel, as a result of which the clearance-producing pivotal movement of the apparatus may be of a lesser magnitude than would otherwise be required.

6 Claims, 4 Drawing Figures

CLEARANCE-PRODUCING MEANS FOR OPEN-END SPINNING MACHINE SERVICING APPARATUS

BACKGROUND OF THE INVENTION

This invention relates to mobile apparatuses that service open-end spinning machines, and more particularly relates to means for permitting unobstructed movement of such an apparatus about an end cabinet of a spinning machine serviced by it.

It is known to provide, in association with open-end spinning machines of the type having a plurality of spinning stations spaced along their lengths, mobile apparatuses that move about the machines and automatically perform one or more service operations—such as rotor-cleaning, yarn-piecing or bobbin-changing—at those spinning stations in need thereof. The path of travel of such a mobile servicing apparatus may extend not only adjacent that main part of the spinning machine along which its spinning stations are spaced, but also adjacent one or both of the opposite ends of the machines. This permits the servicing of both sides of a "two-sided" spinning machine by a single apparatus, and also permits temporary parking of the servicing apparatus at desired times in a location where it will not impede access, by either a machine operator or by another servicing device or apparatus, to any of the spinning stations of the machine.

U.S. Pat. No. 3,990,221 discloses a mobile servicing apparatus that is mounted by a rail affixed to the top of an open-end spinning machine for running movement along and for pivotal movement laterally of a path of travel extending adjacent spinning stations of the machine and also extending adjacent opposite ends of the machine. The capability of the apparatus for pivotal movement is employed while the apparatus is adjacent the spinning stations of the machine to obtain a desired lateral spacing between such stations and a lower portion of the apparatus. When the apparatus is adjacent an end of the spinning machine, control of its pivotal position is assumed by auxillary support or stabilizing means provided at the machine end. The aforesaid means, which includes a rail mounted at an elevation below that of the top of the spinning machine, does not further outwardly displace the lower portion of the apparatus from its previous path of travel. It instead permits, in most if not all instances, the apparatus's lower portion to assume a position wherein the same is laterally displaced further inwardly of its path of travel than at any other time. This procedure is unacceptable when the serviced spinning machine has projecting cabinet-like structures at its opposite ends that obstruct movement of the servicing apparatus thereabout. If used in association with such a spinning machine, the aforesaid auxillary support or stabilizing means would not provide clearance for movement of the servicing apparatus about the machine ends. In addition to not being intended or adapted for performance of the foregoing function, the location of the components of such means is not an optimum one either from the foregoing viewpoint or from the viewpoint of permitting unobstructed movement of traffic along aisles adjacent ends of a spinning machine.

OBJECTS OF THE INVENTION

The primary object of the invention is the provision, in association with a mobile servicing apparatus mounted for movement along a path of travel extending adjacent spinning stations and adjacent at least one end cabinet of an open-end spinning machine, of clearance-producing means that permits free movement of the servicing apparatus adjacent the cabinet when such movement would otherwise not be possible.

A related and more specific object is provision of cam means, effective upon movement of a servicing apparatus from a section of its path of travel adjacent spinning units of a spinning machine to a path section adjacent an end cabinet of the machine, for pivoting the servicing apparatus laterally of its path of travel to provide clearance between interfering components of the cabinet and the apparatus.

Another more specific object is the provision of cam means, of the above noted type, that is so located as to minimize the force required to pivot the servicing apparatus, and as to not in any way tend to obstruct or impede aisle traffic adjacent ends of the spinning machine.

Still another object is the provision in a servicing apparatus of the above-described type of a support or stabilizing member that is movable from an extended to a retracted position to facilitate passage of the apparatus adjacent an end cabinet of the spinning machine.

SUMMARY OF THE INVENTION

A servicing apparatus is mounted association with an open-end spinning machine, by mounting means located above the machine and extending generally parallel to its periphery, for running movement along and pivotal movement laterally of a path of travel having a first section adjacent the machine's spinning stations and having a second section adjacent an end cabinet of the machine. The apparatus normally occupies a pivotal position wherein it is movable freely along the first section of its path of travel but wherein movement thereof along the second section of such path is obstructed by lateral interference between the lower portion of the apparatus and the cabinet structure of the spinning machine. Such lateral interference is eliminated by cam means, disposed at an elevation above the spinning machine and operatively associated with an upper portion of the servicing apparatus, that during movement of the apparatus from the first and to the second section of its path of travel pivots the apparatus in a direction displacing its lower portion laterally outwardly from the machine's end cabinet sufficiently for the same to clear the cabinet and for the apparatus to move freely along the second section of its path of travel. The cam means is so located as to not impede traffic movement adjacent the machine, and as to minimize the force required for realization of the desired clearance-producing pivotal movement of the servicing apparatus.

When the lateral interference between the servicing apparatus and the spinning machine is attributable in part to a stabilizing assembly that extends to the machine from the frame of the lower portion of the apparatus while the same is within the first section of its path of travel, mounting and drive means may be provided in association with such assembly for effecting retraction thereof as the apparatus passes from the first and to the second section of its path of travel. Retraction of the assembly reduces the magnitude of the pivotal movement that must be imparted to the apparatus for clearance purposes. The mounting of the assembly is of a "fail-safe" type assuring that the assembly will not undergo spontaneous retraction.

DESCRIPTION OF THE DRAWINGS

Still other objects and features of the invention will be apparent from the following description of illustrative embodiments thereof, which should be read in conjunction with the accompanying drawings, in which.

DESCRIPTION OF THE PREFERRED EMBODIMENTS

Figure 1:
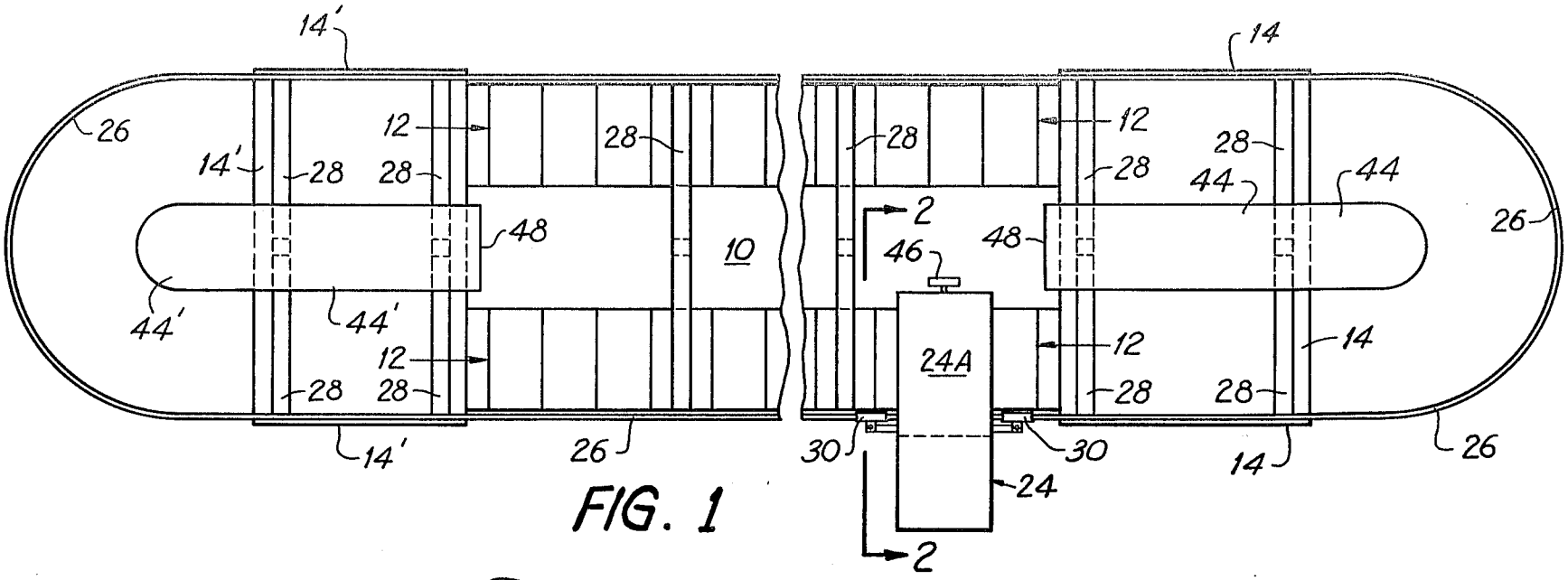
FIG. 1 is a partially schematic top plan view of a mobile servicing apparatus mounted for movement about an open-end spinning machine, broken away intermediate its length, and of associated clearance-producing means in accordance with the invention.
Figure 2:
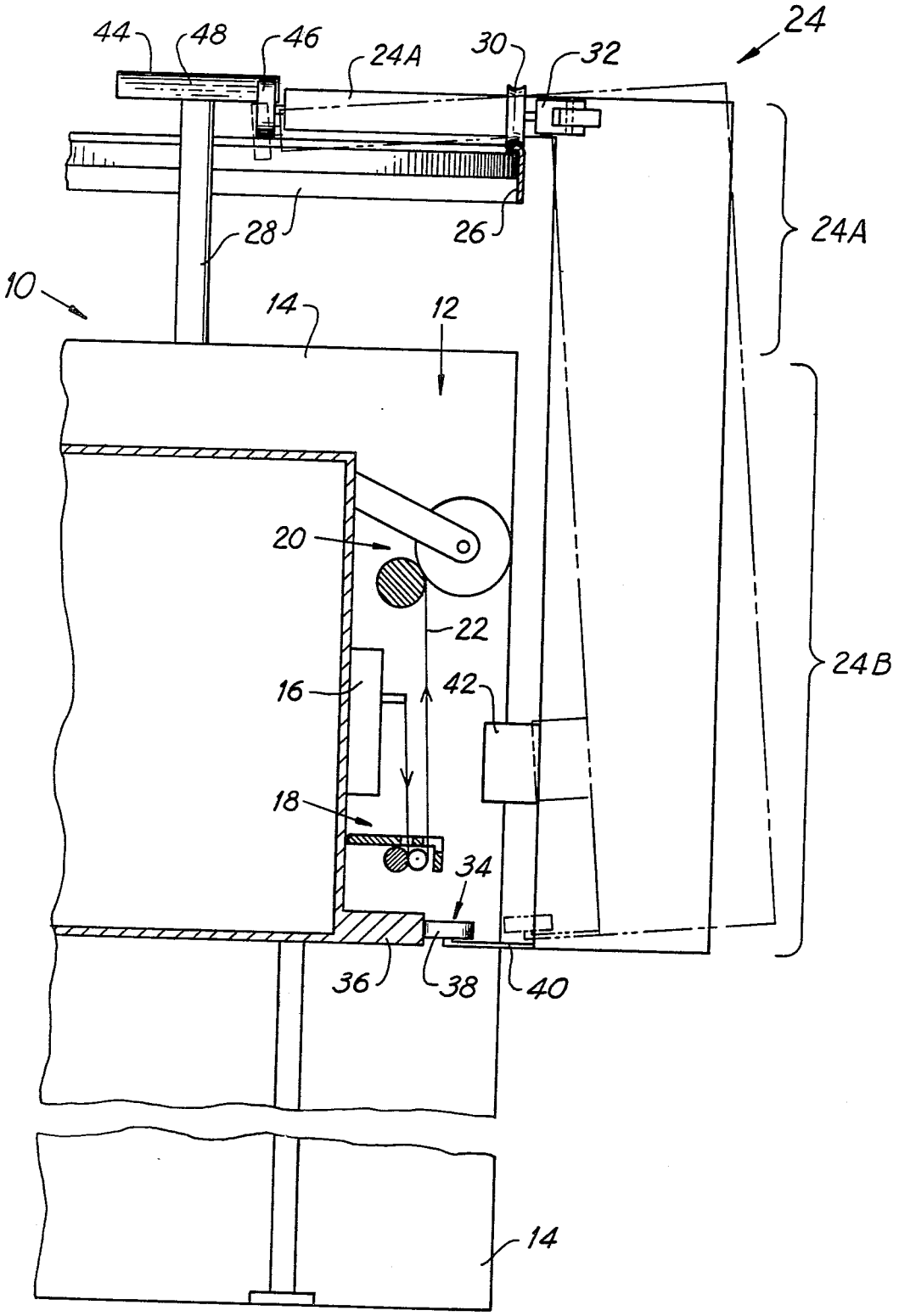
FIG. 2 is an enlarged view, primarily in elevation but partially in vertical section, taken substantially along the line 2—2 of FIG. 1 and showing in solid and phantom lines the pivotal positions respectively occupied by the servicing apparatus when it is adjacent a spinning station of the spinning machine and when it is adjacent an end cabinet of the machine.
Figure 3:
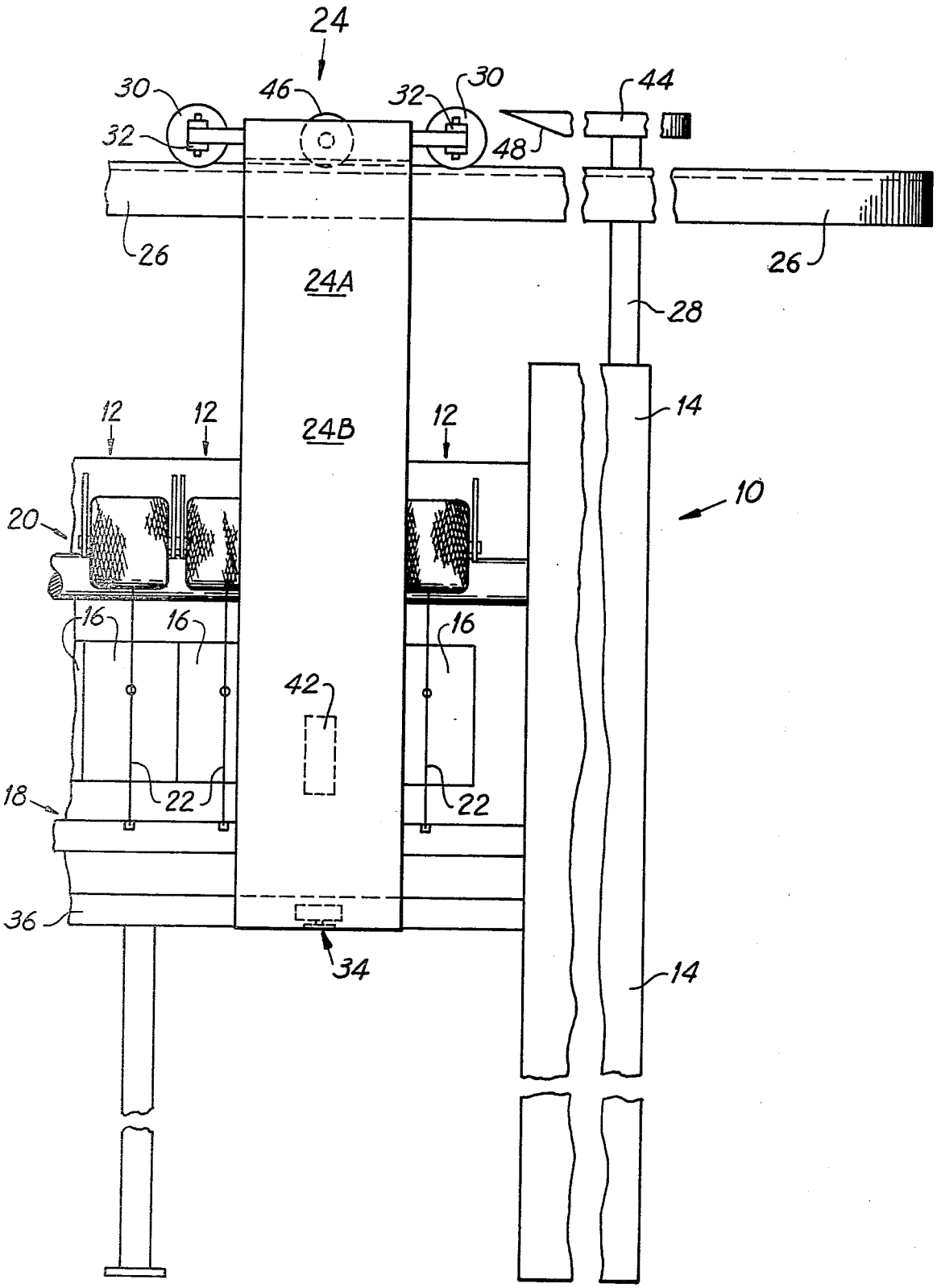
FIG. 3 is an enlarged front elevational view of the servicing apparatus and foreshortened parts of the spinning machine and the clearance-producing means shown in FIG. 1.

In FIG. 1 of the drawings the numeral 10 designates an open-end spinning machine having spinning stations 12 spaced along the length of both sides of its elongate central portion, and having at its opposite ends cabinet structures 14, 14' whose illustratively-equal widths are greater than the width of the central section of the machine. Referring now also to FIGS. 2 and 3, each spinning station 12 includes a spinning unit 16, a yarn delivery roll assembly 18, and a yarn take-up assembly 20. During normal operation of a spinning station 12, sliver (not shown) conducted to its spinning unit 16 is spun into yarn 22 which passes first downwardly from unit 16 to delivery roll assembly 18, and then passes upwardly to take-up assembly 20 where it is wound upon a rotating bobbin to form a yarn package. As is well known to those skilled in the art, spinning stations 12 must be serviced in various respects. The rotor or spinning-chamber component (not shown) of each spinning unit 16 must be periodically cleaned. If the yarn 22 at a station 12 should break, a so-called "piecing" operation must be performed to restore the station to production. Additionally, when the desired amount of yarn has been wound upon the bobbin at a station 12, an empty bobbin must be substituted for the full one. It has heretofore been proposed to provide, in association with open-end spinning machines, mobile servicing apparatuses that move about the machines to the various spinning stations thereof and that automatically perform all or desired ones of the aforesaid servicing functions.

Such a mobile apparatus is designated in its entirety in FIGS. 1-3 of the drawings by the numeral 24. The servicing components of apparatus 24 are not shown in the drawings, since they do not form part of the present invention and may be of any type suitable for the automatic performance by the apparatus of a rotor-cleaning, a yarn-piecing and/or bobbin-changing operation at any of the spinning stations 12 of machine 10 in need of the particular type or types of servicing rendered by the apparatus. Apparatus 24 is mounted for running movement about machine 10, illustratively in a counterclockwise direction as viewed in FIG. 1, along a path of travel having first sections respectively extending adjacent opposite sides of the machine's elongate central portion, and having second sections respectively extending adjacent opposite ones of the machine's end cabinets 14, 14'. The mounting of apparatus 12 is such that the same is also pivotally movable laterally of its aforesaid path of travel. The means by which apparatus 24 is so mounted includes an endless rail 26 supported in vertically-spaced relationship to machine 10 by suitable standards 28 projecting upwardly from the top of the machine. Rail 26 extends horizontally in generally parallel relationship to the periphery of machine 10. While the arcuate end portions of rail 26 project outwardly beyond the ends of machine 10, they are so far above any aisles that might and normally would be present at such locations as to not impede the movement of personnel or vehicles, including even relatively tall fork-lift trucks, along such aisles. The means mounting apparatus 24 further includes a plurality of rail-engaging wheels 30, at least one of which has drive means (not shown) associated therewith, secured by movable brackets 32 to that upper portion 24A of apparatus 24 that lies above the elevation of the top of spinning machine 10. Brackets 32 permit the generally horizontal and normally parallel axes of wheels 30 to undergo such limited movement relative to each other as is necessary for the wheels to negotiate the arcuate end portions of rail 26. The upper edge of rail 26 and the rail-engaging circumferences of wheels 30 have complementary arcuate surfaces so that apparatus 24 is supported thereby not only for running movement along the length of its aforesaid path of travel, but also is pivotally movable laterally of such path of travel about the substantially horizontal axis defined by the interface between the complementary arcuate surfaces of the rail and wheels. The location of the center of gravity of apparatus 24 in relation to the aforesaid pivot axis is such that the apparatus tends to pivot in a clockwise direction, as viewed in FIG. 2, toward and beyond the pivotal position thereof shown by solid lines in FIG. 2.

Apparatus 24 normally is disposed intermediate the length of one or the other of those first sections of its path of travel that extend adjacent the spinning machine stations 12 patrolled and serviced by the apparatus. The pivotal position of apparatus 12 then is its normal one shown in FIGS. 1 and 3 and by solid lines in FIG. 2. In its normally-occupied pivotal position, that lower portion 24B of apparatus 24 that extends below the elevation of the top of machine 10 is substantially vertical, and the uppermost part of apparatus portion 24A extends generally horizontally inwardly to a location adjacent the vertical plane of longitudinal symmetry of machine 10. Apparatus 24 is stabilized in its normally-occupied pivotal position shown by solid lines in FIG. 2, and prevented from pivoting further in a clockwise direction therefrom, by a stabilizing assembly 34 carried by and projecting laterally from the bottom of its lower portion 24B toward the adjacent one of a pair of rails 36 (only one of which is shown in the drawings) affixed to and extending longitudinally of opposite sides of the machine's elongate central portion upon which spinning stations 12 are spaced. Assembly 34 comprises an arm 40 fixedly mounted at its inner end to the frame or housing of apparatus lower portion 24B, approximately midway of the length thereof, and a wheel 38 mounted at the free outer end of such arm for rotation about an upstanding axis. When apparatus 24 is intermediate the length of either of the first sections of its path of travel, engagement of wheel 38 with the adjacent rail 36 stabilizes the apparatus both during its free running movement along such path section and during its servicing of the spinning stations 12 adjacent thereto.

While apparatus 24 may run freely along either of the first sections of its path of travel while occupying its normal (solid line, FIG. 2) pivotal position, it cannot while in such pivotal position move completely from a first and to a second section of its path of travel. Such movement of the apparatus is prevented by lateral interference between the projecting end cabinets 14, 14' of machine 10 and one or more components of lower portion 24B of apparatus 24. As illustratively shown in FIG. 2, the latter include stabilizing assembly 34 and a second component 42 (also shown by phantom lines in FIG. 3) disposed thereabove upon apparatus portion 24B. The nature of component 42 is immaterial to the present invention, and the same might constitute a projection of the frame or housing of apparatus 24 or a part of any of its servicing or other mechanisms.

In accordance with the present invention, cam means are provided in association with machine 10 and apparatus 24 for, during movement of the apparatus from a first and to a second section of its path of travel, pivoting the apparatus in a direction (counterclockwise as viewed in FIG. 2) and through a distance sufficient to so displace apparatus lower portion 24B laterally outwardly from the interfering one of the cabinets 14, 14' as to provide lateral clearance between such cabinet and apparatus components 34,42. The aforesaid cam means includes a pair of substantially horizontal cam plates 44, 44' that overlie and span the lengths of the central portions of respective ones of cabinets 14, 14' of machine 10, and are bisected by the vertical plane of longitudinal symmetry of the machine; and a cooperating cam wheel 46 mounted upon a terminal end of apparatus upper portion 24A closely adjacent such vertical plane. Plates 44, 44' may be and illustratively are supported by thereto adjacent ones of the same standards 28 that support rail 26, and in a horizontal direction they are spaced inwardly of and distally from such rail. In a vertical direction plates 44, 44' are located at an elevation at least closely adjacent and preferably and illustratively somewhat above the elevation of rail 26. The portions of the plates that project beyond the opposite ends of machine 10 therefore do not impede movement of personnel or vehicles along aisles adjacent the machine. At its opposite end each plate 44, 44' has a sloping edge portion 48 that projects a short distance into overlying relationship with the elongate central portion of machine 10. As apparatus 24 moves from a first and to a second section of its path of travel, the cam wheel 46 upon its upper portion 24A engages edge portion 48 of the thereto adjacent one of cam plates 44, 44', and is forced downwardly by the slope of such edge portion to the undersurface of the cam plate. This pivots apparatus 24 from its normally occupied (solid line) pivotal position to an inclined pivotal position, such as shown in FIG. 2 by phantom lines, wherein its lower portion 24B is displaced laterally outwardly from machine 10 a distance providing lateral clearance between apparatus components 34, 42 and the interfering cabinet 14 (in FIG. 2) or 14' of machine 10. The assumption by apparatus 24 of its inclined pivotal position therefore permits the same to complete its movement onto the second section of its path of travel, and to then run freely along the entire length thereof to the other first path section upon the opposite side of machine 10. Continued engagement of its wheel 46 by the undersurface of cam plate 44 (in FIG. 2) or 44' maintains apparatus 24 in its inclined position until the same moves from the second and to the other first section of its path of travel. At that time the passage of wheel 46 along and from the sloping edge portion 48 of the plate permits and controls return pivotal movement of apparatus 24 back to the normal (solid line) pivotal position thereof wherein the wheel 38 of its stabalizing assembly 34 engages one of the rails 36 of machine 10.

The force required for the aforesaid cam means to effect the desired clearance-producing pivotal movement of apparatus 24 is minimized by the leverage effect resulting from such cam means being spaced distally from the rail 26 about which apparatus 24 pivots. It will also be noted that the location of the cam means in no way impedes access to either machine cabinet 14, 14' via the doors (not shown) customarily provided upon one or both sides thereof.

Figure 4:
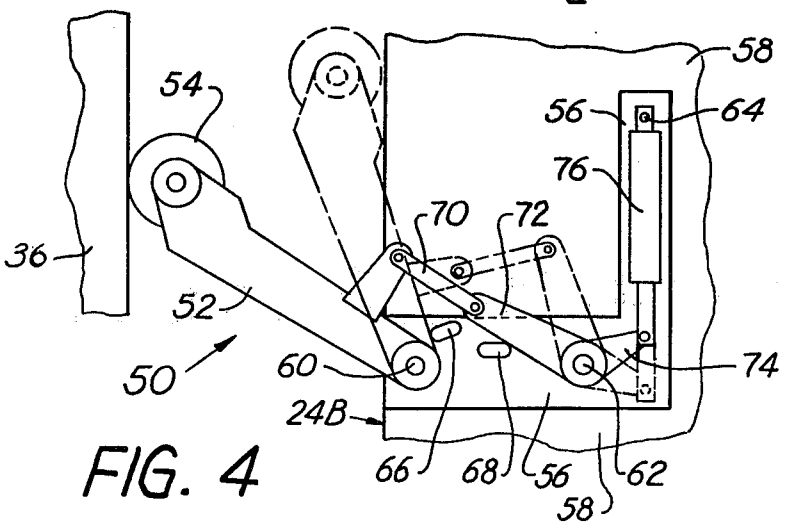
FIG. 4 is an enlarged fragmentary top plan view showing an extendable and retractable embodiment of a stabilizing assembly and associated mounting and drive means carried by the lower portion of the servicing apparatus.

If one or both cabinets 14, 14' has a width dimension greater than that shown, the greater degree of clearance-producing movement required for clearance thereof by apparatus 24 could of course be achieved by the use of thicker cam plates 44 and/or 44'. Conversely, if cabinets 14, 14' had a smaller width dimension than that shown, such that a lesser degree of pivotal movement of apparatus 24 would permit its free travel thereabout, thinner plates 44, 44' might be employed. The use of thinner plates 44, 44' and ensuing reduction in the amount of clearance-producing pivotal movement imparted to apparatus 26 is also possible when an alternative type of stabilizing assembly 50, shown in FIG. 4 of the drawings, is employed in association with apparatus lower portion 24B in lieu of the previously described assembly 34. Assembly 50 includes an arm 52 and a wheel 54 that correspond generally to the arm 40 and wheel 38 of previously-described assembly 34. However, instead of being fixedly secured to the housing or frame of portion 24B of apparatus 24, arm 52 and wheel 54 are mounted for movement relative to the housing or frame of apparatus portion 24B between forwardly extended and rearwardly retracted positions, respectively shown by solid and phantom lines in FIG. 4, under the impetus of drive means connected thereto and carried by the apparatus. The means by which arm 52 and wheel 54 are mounted includes a bracket 56 secured in any suitable manner upon a frame plate 58 of lower portion 24B of apparatus 24. Shafts 60,62,64 and stop members 66,68 project upwardly from bracket 66. Shaft 60 extends through the inner end portion of arm 52 of assembly 50, and mounts such assembly for pivotal movement between its extended and retracted positions. A linkage 70 pivotally interconnects arm 52 and one arm 72 of a bell crank lever pivotable about the axis of bracket shaft 62. The other bell crank arm 74 is pivotally connected to the rod component of a double-acting piston and cylinder unit 76 whose cylinder is pivotally connected to the remaining bracket shaft 64.

When apparatus 24 is intermediate the length of either first section of its path of travel, stabilizing assembly 50 occupies its extended solid-line position wherein wheel 54 engages one of the machine rails 36 and bell crank arm 72 engages bracket stop 68. Assembly 50 would continue to occupy its extended position, and would thus continue to laterally stabilize apparatus 24, even if a malfunction should cause interruption of the supply of motive fluid to piston and cylinder unit 76. This desirable "fail-safe" feature arises from the fact that when assembly 50 is extended, the pivotal connection between linkage 70 and bell crank arm 72 is so offset from its dead-center position as to cause the load forces upon the assembly to bias bell crank arm 72 toward bracket stop 68. During each passage of apparatus 24 from a first and to a second section of its path of travel, control means (not shown) operatively associated with piston and cylinder unit 76 effects extension of such unit. This in turn produces pivotal movement of stabilizer assembly 50 to its retracted position, wherein its arm 52 engages bracket stop 66. The retracted assembly 50 is so closely adjacent the housing or frame of lower portion 24B of apparatus 24 as to not impede movement of the apparatus along the second section of its path of travel even when the lateral pivotal movement imparted to it by the previously described cam means is of a reduced magnitude just sufficient to provide minimum clearance between its component 42 (FIGS. 2 and 3) and the adjacent end cabinet 14 or 14' of machine 10. During each passage of apparatus 24 from a second and to a first section of its path of travel, the control means (not shown) associated with piston and cylinder unit 76 effects retraction of such unit, and ensuing return of assembly 50 to its extended (solid state) position. The control means associated with piston and cylinder unit 76 may be of any conventional type producing extension and retraction of the unit at the aforesaid desired times, as by its inclusion and utilization of one or more switches responsive to either the pivotal orientation of apparatus 24 or to the location thereof along the length of its path of travel.

While specific embodiments of the invention have been shown and described, it is to be understood that was for purposes of illustration only, and not for purposes of limitation, the scope of the invention being in accordance with the following claims.

That which is claimed is:

1. In combination, an elongate open-end spinning machine having a plurality of spinning stations spaced along its length and having a cabinet structure at one thereof; an upstanding mobile servicing apparatus, having upper and lower portions respectively disposed above and below the top elevation of said spinning machine, adapted to move about said spinning machine along a path of travel having a first section adjacent said spinning stations of said spinning machine and having a second section adjacent said cabinet structure of said spinning machine; mounting means, extending in vertically spaced overlying relationship to the periphery of said spinning machine, mounting said apparatus for said movement thereof along its said path of travel, and for pivotal movement of said apparatus transversely of its said path of travel; said apparatus normally occupying a pivotal position wherein said apparatus is movable freely along said first section of its said path of travel and wherein movement thereof along said second section of its path of travel is obstructed by lateral interference between said lower portion of said apparatus and said cabinet structure of said machine; cam means, disposed at an elevation above said spinning machine and operatively association with said upper portion of said apparatus for, during movement of said apparatus from said first and to said second section of its said path of travel, pivoting said apparatus in a direction displacing said lower portion thereof laterally outwardly from said cabinet structure of said machine sufficiently for said lower portion of said apparatus to clear said cabinet structure and for said apparatus to move freely along said second section of its said path of travel.

2. The combination of claim 1, wherein said cam means is disposed at an elevation above said spinning machine adjacent the elevation of said mounting means.

3. The combination of claim 1 or 2, wherein said cam means is closely adjacent the vertical plane of longitudinal symmetry of said spinning machine and is distally spaced in a horizontal direction from said mounting means.

4. The combination of claim 1, wherein said mounting means includes an elongate rail member, and a plurality of rail-engaging wheels carried by said upper portion of said apparatus at spaced locations along its length; said cam means including a cam wheel mounted upon said upper portion of said apparatus in laterally spaced distal relationship to, and at approximately the same elevation as, said rail-engaging wheels; and a cam plate mounted above said machine and closely adjacent the vertical plane of longitudinal symmetry thereof for, during movement of said apparatus from said first and to said second section of its said path of travel, engaging said cam wheel and displacing the same downwardly to thereby effect said pivotal movement of said apparatus.

5. The combination of claim 1, wherein said apparatus includes a stabilizing assembly adapted to stabilize said apparatus while the same is intermediate said first section of said path of travel thereof; means mounting said assembly upon the frame of said lower portion of said apparatus for movement of said assembly between an operable extended position, wherein said assembly projects distally outwardly from said frame and interferes with movement of said apparatus along said second section of its path of travel, and an inoperable retracted position wherein said assembly is closely adjacent said frame; and drive means carried by apparatus for moving said assembly from its said extended position and to its said retracted position during passage of said apparatus from said first and to said second section of said path of travel thereof.

6. The combination of claim 1, wherein said drive means includes a drive unit; linkage means innerconnecting said drive unit and said assembly, and means associated with said linkage means for preventing spontaneous movement of said assembly to its said retracted position.

* * * * *